US006302744B1

(12) United States Patent
Nomura

(10) Patent No.: US 6,302,744 B1
(45) Date of Patent: Oct. 16, 2001

(54) CONNECTOR SYSTEM WITH POLARIZING KEY MECHANISM

(75) Inventor: Satoshi Nomura, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/408,468

(22) Filed: Sep. 28, 1999

(30) Foreign Application Priority Data

Oct. 13, 1998 (JP) ..... 10-290765

(51) Int. Cl.[7] ..... H01R 13/64
(52) U.S. Cl. ..... 439/680
(58) Field of Search ..... 439/680, 681, 439/607, 701

(56) References Cited

U.S. PATENT DOCUMENTS 4,070,080 * 1/1978 Eshleman et al. ..... 439/680
4,368,942 * 1/1983 Mathe et al. ..... 439/680
4,580,868 * 4/1986 Verstijnen ..... 439/680
4,787,860 * 11/1988 Bender ..... 439/680
5,044,994 9/1991 Van Woensel ..... 439/681

FOREIGN PATENT DOCUMENTS 01-174880 7/1989 (JP) ..... F26B/15/18

* cited by examiner

*Primary Examiner*—Renee Luebke
*Assistant Examiner*—Felix O. Figueroa
(74) *Attorney, Agent, or Firm*—Matthew B. McNutt

(57) ABSTRACT

A connector system 10 includes a polarizing key mechanism permitting only a specific combination of a pair of first and second connectors 12, 14 to be connected with each other. The polarizing key mechanism includes a frame-shaped first guide member 40 arranged around a fitting portion 22 of the first connector 12, and a frame-shaped second guide member 42 arranged around a fitting portion 32 of the second connector 14. Two grooves 48 are formed to be recessed on the outer surface of the opposed longitudinal parts of a first wall 44 of the first guide member 40. Two ribs 52 are formed to project from the inner surface of the opposed longitudinal parts of a second wall 50 of the second guide member 42. The first and second guide members 40, 42 permit the first and second connectors 12, 14 to be connected with each other only when the grooves 48 are compensatingly engaged with the ribs 52.

8 Claims, 8 Drawing Sheets

CONNECTOR SYSTEM WITH POLARIZING KEY MECHANISM

This application claims priority pursuant to Title 35, United States Code, Section 119, based upon the earlier filed foreign application No. JP10-290765, filed on Oct. 13, 1998.

TECHNICAL FIELD OF THE INVENTION

The present invention relates to an electrical connecting apparatus, and more particularly to a connector system comprising a pair of first and second connectors, each of which includes a fitting portion to be fitted to a counterpart fitting portion in a mutually inserting manner to establish an electrical connection between the pair of connectors, and a polarizing key mechanism permitting only a specific combination of the first and second connectors to be connected with each other.

DESCRIPTION OF THE PRIOR ART

Conventionally, in an I/O interface of the electronic apparatus such as a personal computer, to correctly connect an electronic apparatus with a desired counterpart apparatus, it has been known that a polarizing key function is added to the I/O interface for permitting only one specific combination of connectors between an I/O cable and a circuit board. Recently, as the electronic apparatus has increasingly been smaller in size and become higher in performance, a degree of allowance of electronic components used therein is liable to lower, against an external interference such as an application of excessive voltage. Accordingly, it is important for the I/O interface of such a high performance electronic apparatus to have a function for surely preventing the erroneous connection of the apparatus, i.e., the erroneous insertion of connectors, in view of safety for avoiding in advance a failure of the electronic apparatus caused by a careless mistake.

Also, nowadays, a standardization of a digital interface has been discussed in persons pertaining to this industrial field, for connecting an information processor such as a personal computer with a display such as a liquid crystal monitor while keeping the interchangeability. Under such circumstances, it is not desirable from a point of view of a manufacturing cost, to newly develop connectors for the interface matching with a new standard, but is advantageous to basically use those of the conventional structure. In the latter case, it is necessary that the connector used for the interface of the new standard has the above-mentioned function for preventing the erroneous insertion into another connector of the same structure but used for a different use application.

For example, Japanese Unexamined Utility Model Publication (Kokai) No. 1-174880 discloses a prior art connector system having this type of a polarizing key function. In the connector system, a male connector for a cable has a shell covering a connector body, while a projection extending in the connector-fitting direction is provided at a desired position on an end surface of the shell to be fitted to the female connector. Contrarily, the female connector for a circuit board is arranged so that a fitting portion thereof to be fitted to the male connector is exposed out from an opening of a metallic panel of an apparatus housing, and has a notch groove engageable with the projection of the shell at a desired position of the periphery of the opening of the panel. Thus, a specific combination of the male and female connectors wherein positions of the projection of the shell and the notch groove of the panel coincide with each other solely permits the mutual connection of both the connectors by the engagement of the projection with the notch groove.

The prior art connector system having the above-mentioned polarizing key function is capable of preventing the male connector having the projection in the shell and the female connector having the notch groove in the panel from being connected to each other unless they satisfy the specific combination. However, if a conventional male connector of the same structure as the above-with only one exception that the shell has no projection is used for another I/O cable, the above connector system is incapable of preventing the conventional male connector from being connected with the female connector even though the notch groove is provided in the panel. Accordingly, in a case wherein a conventional connector is used for the above-mentioned new standard interface, this connector system is risky.

When male and female connectors other than the specific combination are connected to each other, there is a possibility in that the projection of the shell of And the male connector abuts to the panel to cause an unintentional rotation of the male connector about the projection, which results in a risk wherein some of the contacts in both the connectors are partially in contact with each other. Further, there is a possibility in that the projection of the shell is inadvertently inserted into the fitting portion of the female connector, which may cause a short circuit between contacts of the female connector if the entire shell or the projection thereof is made of metal. Such a partial contact or short circuit between the contacts may cause the above-mentioned failure of the high performance electronic apparatus.

In addition, the high performance electronic apparatus is required for having an increased electromagnetic shielding function in the I/O interface. However, the notch groove provided in the panel on the female connector side is liable to adversely influence the electromagnetic shielding function. Since either the projection of the shell or the notch groove of the panel is provided at a random position, it is necessary to assemble the shell with the panel while confirming the polarity of the male and female connectors so that the projection is receivable in the notch groove when both the connectors are connected to each other. This affects the workability.

Thus, an object of the present invention is to provide a connector system with a polarizing key function permitting only one specific combination of connectors, capable of preventing the erroneous insertion of the connector while avoiding the partial contact or the short circuit between contacts of the connectors, whereby the safety is significantly facilitated upon the connection between small-sized and high-performance electronic apparatuses.

Another object of the present invention is to provide a connector system with a polarizing key function permitting only one specific combination Of connectors, capable of surely preventing the erroneous insertion not only of a connector having a polarizing key function according to the present invention but also of that having no such a function.

Further object of the present invention is to provide a connector system having a polarizing key function, wherein an electromagnetic shielding function is more facilitated in an I/O interface.

Yet another object of the present invention is to provide a connector system wherein a polarizing key function can easily and correctly be added even to a connector having a polarity in a fitting portion.

SUMMARY OF THE INVENTION

To accomplish the above objects, the invention provides a connector system comprising a pair of first and second connectors, each of which includes a fitting portion to be fitted with a counterpart fitting portion in a mutually inserting manner to establish an electrical connection between the first and second connectors, and a polarizing key mechanism permitting only a specific combination of the first and second connectors to be connected with each other, characterized in that the polarizing key mechanism comprises a first guide member provided around the fitting portion of the first connector, the first guide member including a plurality of engaging sections; and a second guide member provided around the fitting portion of the second connector, the second guide member including a plurality of engaging sections which can be compensatingly engaged with the plurality of engaging sections of the first guide member; wherein the first and second guide members permit the first and second connectors to be connected with each other only when the engaging sections of the first guide member are compensatingly engaged with the engaging sections of the second guide member, and guide the first and second connectors under a compensating engagement between the engaging sections in such a direction as to cause a parallel translation of the fitting portions of the first and second connectors while maintaining a face-to-face arrangement of the fitting portions.

The invention further provides a connector system as set forth above, wherein the engaging sections of each of the first and second guide members are located at both sides of a horizontal sectional center plane dividing the fitting portion of each of the first and second connectors into upper and lower parts and at both sides of a vertical sectional center plane dividing the fitting portion into right and left parts.

The invention further provides a connector system as set forth above, wherein the fitting portion of each of the first and second connectors has a polarity, and wherein the engaging sections of each of the first and second guide members are located at positions symmetric with respect to a center point of the fitting portion of each of the first and second connectors.

The invention still further provides a connector system as set forth above, wherein the polarizing key mechanism further comprises a first abutting section provided in the first connector in association with the first guide member for abutment with another connector which cannot be compensatingly engaged with the first guide member to prevent the first connector from being connected with the other connector, and a second abutting section provided in the second connector in association with the second guide member for abutment with further connector which cannot be compensatingly engaged with the second guide member to prevent the second connector from being connected with the further connector.

The invention still further provides a connector system as set forth above, wherein the first guide member includes a first wall substantially surrounding the fitting portion of the first connector, the engaging sections of the first guide member being grooves formed on the first wall and extending along a direction of insertion of the first connector to the second connector, and wherein the second guide member includes a second wall substantially surrounding the fitting portion of the second connector to define a gap for receiving the first wall between the second wall and the fitting portion, the engaging sections of the second guide member being ribs formed on the second wall and extending along a direction of insertion of the second connector to the first connector, the ribs being adapted to be compensatingly engaged with the grooves.

The invention still further provides a connector system as set forth above, wherein the first connector includes an insulation body provided with the fitting portion and supporting a plurality of contacts, and a shell for covering the insulation body, and wherein the first guide member is structured as a frame member attached to the shell.

The invention still further provides a connector system as set forth above, wherein the first connector includes an insulation body provided with the fitting portion and supporting a plurality of contacts, and a shell for covering the insulation body, and wherein the first guide member is structured as a part of the shell located around the fitting portion.

The invention still further provides a connector system as set forth above, wherein the second connector includes an insulation body provided with the fitting portion and supporting a plurality of contacts, the insulating body being secured to a panel with an opening into which the fitting portion is inserted, and wherein the second guide member is structured as a frame member attached to the panel.

DETAILED DESCRIPTION OF THE INVENTION

The present invention will be described below in detail with reference to the preferred embodiments shown in the attached drawings.

Figure 1:
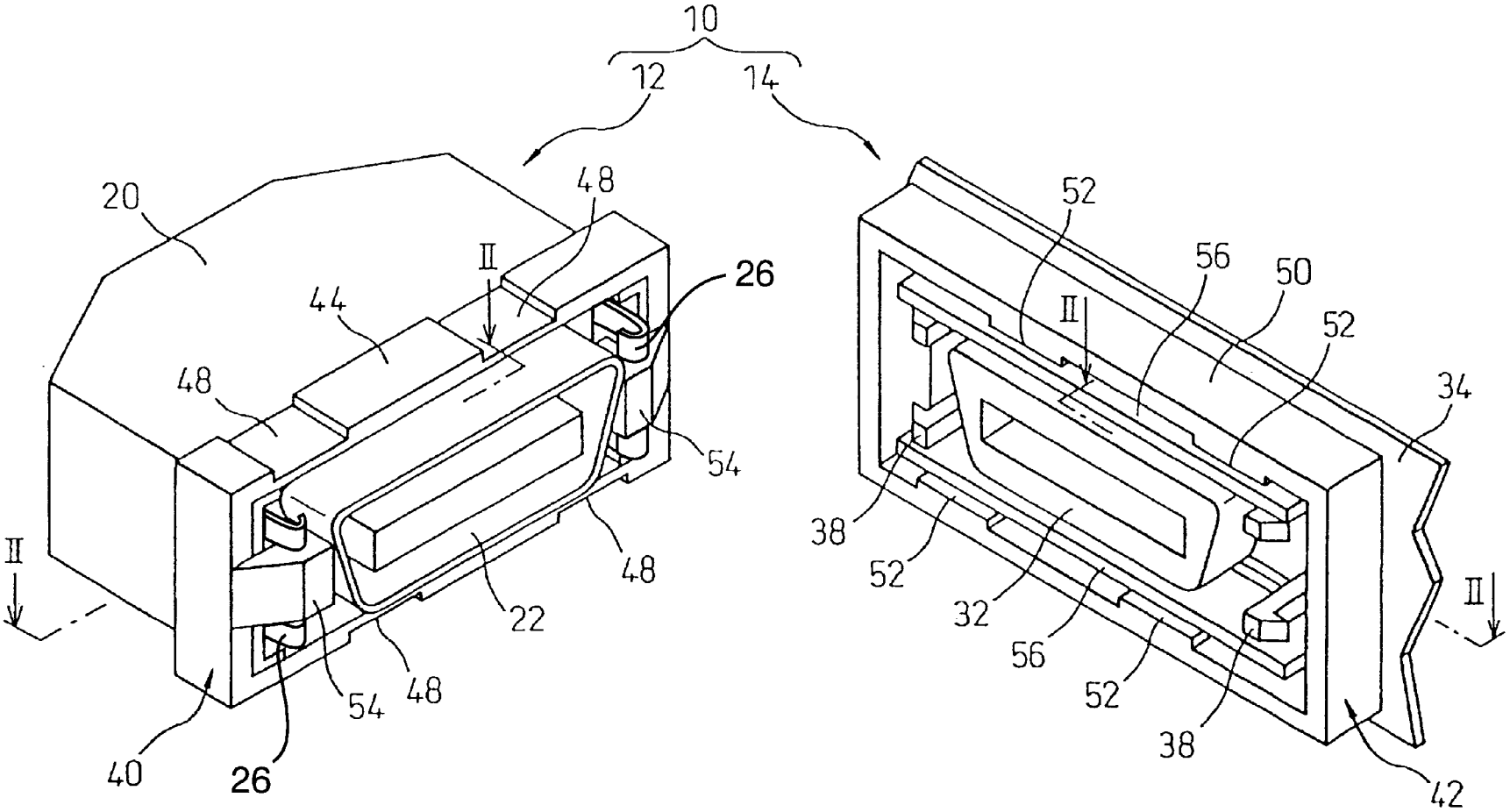
FIG. 1 is a diagrammatic perspective view of a connector system according to one embodiment of the present invention.
Figure 2:
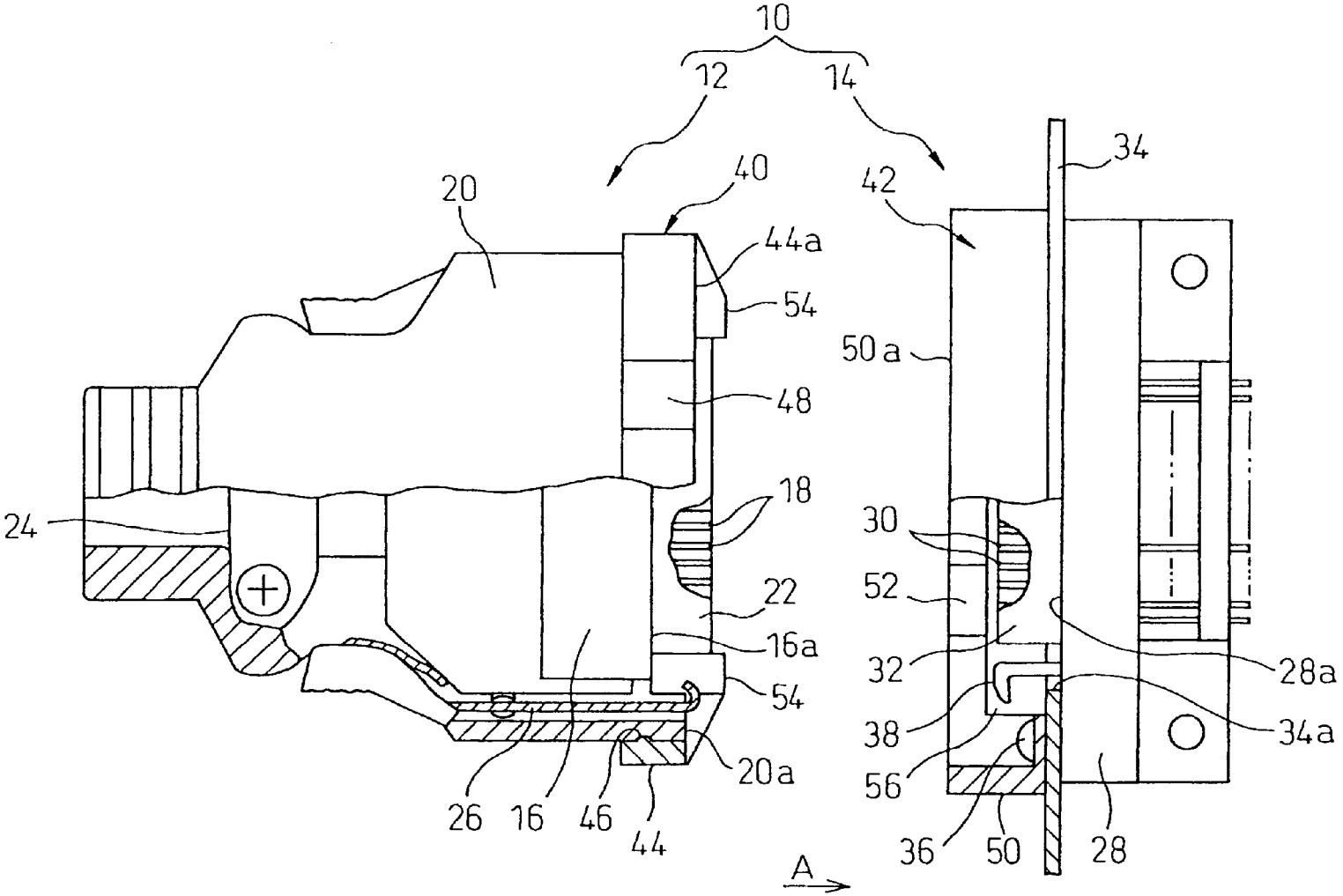
FIG. 2 is a partially sectional plan view, taken along line II—II, of the connector system shown in FIG. 1.

Referring to the drawings, FIG. 1 is a diagrammatic perspective view of a connector system 10 of one embodiment of the present invention, and FIG. 2 is a partially sectional plan view of the connector system 10. The connector system 10 includes a pair of first and second connectors 12, 14 having fitting portions, respectively, for fitting to each other in a mutually inserting manner to establish an electrical connection therebetween, and a polarizing key mechanism permitting only one combination of the first and second connectors 12, 14. Accordingly, the connector system 10 may be suitably used for an I/O interface of an electronic apparatus.

The first connector 12 includes an insulation body 16, a plurality of contacts 18 fixedly supported on and arranged in the body 16 in an array in a mutually insulated state, and a shell 20 covering the body 16. The first connector 12 can be used as a male connector for an I/O cable, and a male type fitting portion 22 wherein slide-contact ends of the contacts 18 are arranged in an array is formed on a front surface 16*a* of the body 16. The fitting portion 22 has a well-known D-shaped profile with a polarity, i.e., a fitting directionality. The shell 20 has a hollow structure capable of accommodating the body 16 and a cable (not shown) therein, opens at a front end 20*a* to expose the fitting portion 22 of the body 16, and is provided at a rear end thereof with a cable holder 24 for securing the cable. The shell 20 is also provided with a pair of pivoted hooks 26 for maintaining the first connector 12 and the second connector 14 in a mutually connected state. Normally, an electromagnetic shielding layer (not shown) is provided between the body 16 and the shell 20.

The second connector 14 has an insulation body 28, and a plurality of contacts 30 fixedly supported on and arranged in the body 28 in an array in a mutually insulated state. The second connector 14 can be used as a female connector for a circuit board of the electronic apparatus, and a female type fitting portion 32 wherein slide-contact ends of the contacts 30 are arranged in an array is formed on a front surface 28*a* of the body 28. Similar to the fitting portion 22, the fitting portion 32 has a well-known D-shaped profile with a polarity, i.e., a fitting directionality. The second connector 14 is fixed to a metallic panel 34 of an apparatus housing with bolts 36 while exposing outward the fitting portion 32 from an opening 34*a* of the panel 34. On the front surface 28*a* of the body 28, a pair of fixed hooks 38 engageable with the pivoted hooks 26 of the shell 20 of the first connector 12 are provided on the opposite sides of the fitting portion 32. The fixed hooks 38 are formed integrally with an electromagnetic shielding cover (not shown) usually mounted to the body 28.

Figure 3:
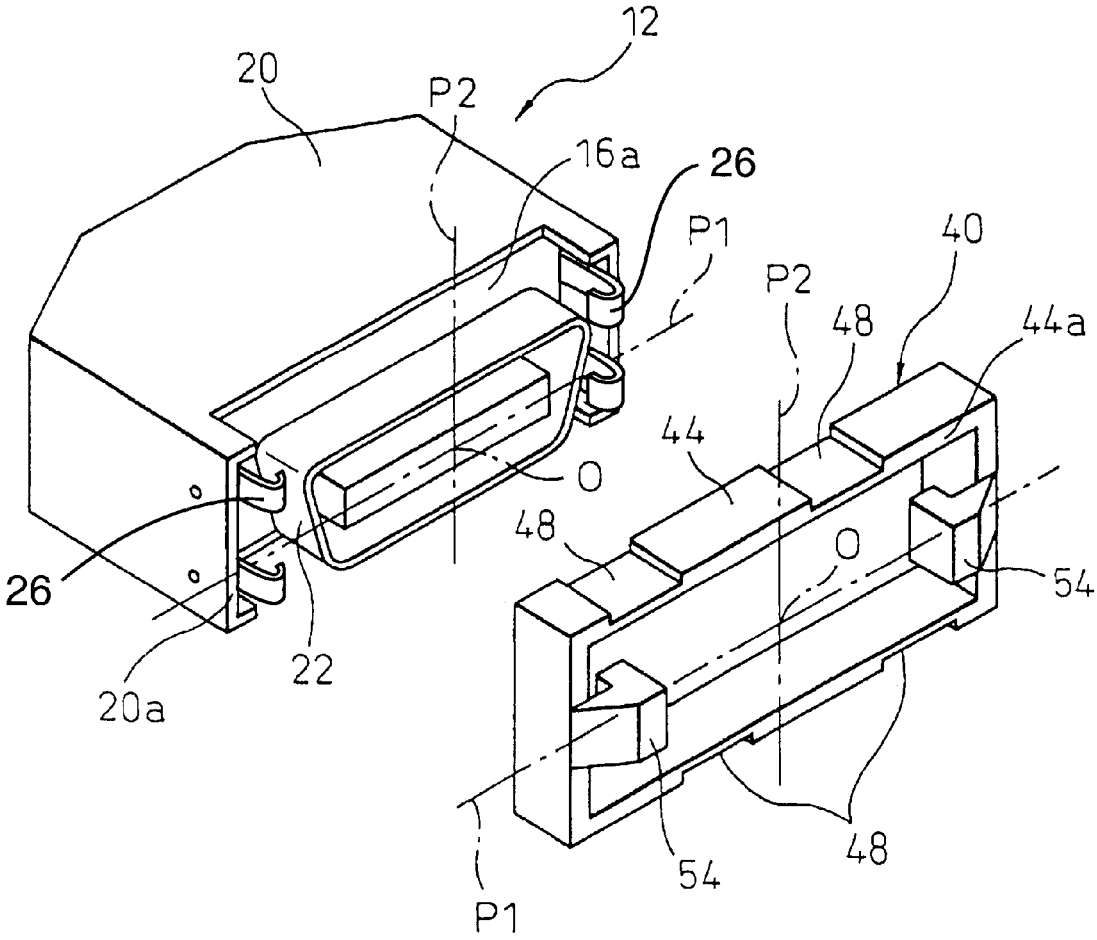
FIG. 3 is an exploded perspective view of a first connector of the connector system in FIG. 1.

The polarizing key mechanism of the connector 35 system 10 includes a first frame-shaped guide member 40 surrounding the fitting portion 22 of the first connector 12, and a second frame-shaped guide member 42 surrounding the fitting portion 32 of the second connector 14. As shown in FIGS. 2 and 3, the first guide member 40 has a first wall 44 having substantially a rectangular frame shape and surrounding the fitting portion 22 of the first connector 12 via a gap, and is attached to the front end 20*a* of the shell 20, for example, via a fitting structure 46 illustrated, with the inner surface of a first wall 44 being in contact with the outer surface of the shell 20. Two grooves 48 are formed at predetermined positions on the outer surface of each of a pair of opposite longitudinal sides of the first wall 44 of the first guide member 40. These grooves 48 linearly extend in a direction perpendicular to a generally flat front end surface 44*a* of the first wall 44. When the first guide member 40 is mounted at a predetermined position to the shell 20, each groove 48 extends in parallel to the inserting direction (shown by an arrow A in FIG. 2) of the first connector 16 into the second connector 14. Normally, the connector-inserting direction A is determined by configurations of the fitting portions 22, 32 of the first and second connectors 12, 14, and substantially coincides with the extending direction of the slide-contact ends of a number of contacts 18, 30 of both the connectors 12, 14.

Figure 4:
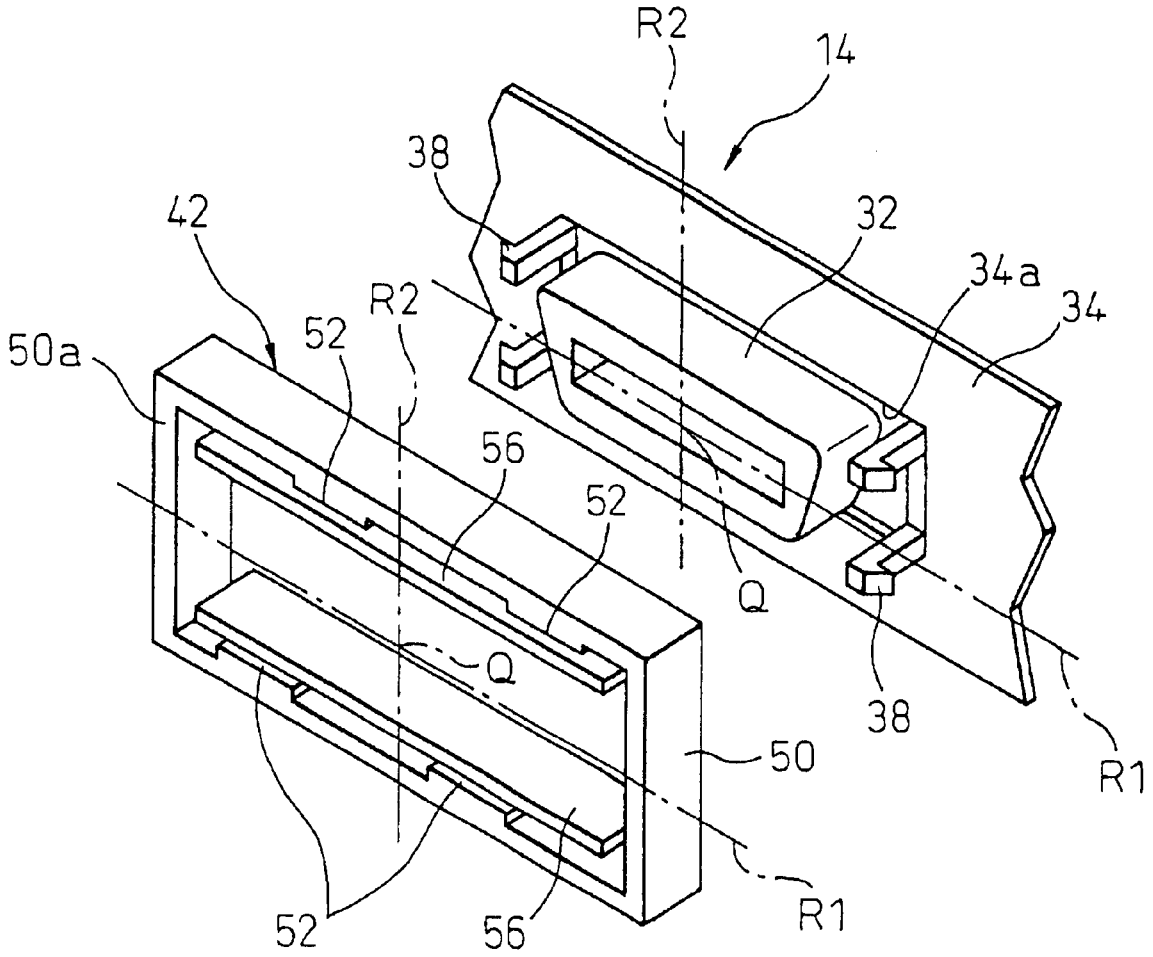
FIG. 4 is an exploded perspective view of a second connector of the connector system in FIG. 1.

As shown in FIGS. 2 and 4, the second guide member 42 has a second wall 50 having substantially a rectangular frame shape and surrounding the fitting portion 32 of the second connector 14 via a gap, and is attached to the front surface of the panel 34 with, e.g., the bolts 36 for fixing the second connector 14 to the panel 34. The second wall 50 of the second guide member 42 has a dimension and a shape capable of receiving the first wall 44 of the first guide member 40 of the first connector 12 in a condition where the inner surface of the second wall 50 is in contact with the entire outer surface of the first wall 44. Two ribs 52 are formed on the inner surface of each of a pair of opposite longitudinal sides of the second wall 50 of the second guide member 42. Each of the ribs 52 has a dimension, a shape and an arrangement compensatingly engageable with each of the grooves 48 of the first guide member 40, and linearly extends in a direction orthogonal to a generally flat front end surface 50*a* of the second wall 50. When the second guide member 42 is attached to a predetermined position of the panel 34, each rib 52 extends in the abovementioned connector-inserting direction A. A front end surface of the respective rib 52 is present on the extension of the generally flat front end surface 50*a* of the second wall 50. In this regard, a term "compensatingly engageable" or "compensating engagement" used in this specification represents such a relationship concerning a dimension, a shape and an arrangement that an engageable counterpart is solely determined in a specific one-to-one correspondence and that a play of engagement is eliminated.

The first guide member 40 and the second guide member 42 permit the mutual connection of the first connector 12 with the second connector 14 when the grooves 48 and the ribs 52 thereof can be compensatingly engaged with each other. That is, the first guide member 40 can be received solely in a specific second guide member 42 having the ribs 52 located at positions corresponding to those of the grooves 48 under the compensating engagement of the respective grooves 48 with the corresponding ribs 52, and thereby, the specific combination of the first and second connectors 12 and 14 including the first and second guide members 40 and 42 can be allowed to be connected with each other.

The first guide member 40 is smoothly accommodated in the second guide member 42 when the compensating engagement is substantially simultaneously started between the grooves 48 and the ribs 52 by opposing the front end surface 44*a* of the first wall 44 of the first guide member 40 substantially parallel to the front end surface 50*a* of the second wall 50 of the second guide member 50. At this time, the first and second connectors 12, 14 are relatively positioned so that the fitting portions 22, 32 thereof are in a face-to-face arrangement, and the mutual engagement is carried out in this condition. Further, under the compensating engagement of the grooves 48 and the ribs 52, the first and second connectors 12, 14 are guided so that the fitting portions 22, 32 are subjected to a parallel translation while maintaining a face-to-face arrangement. Consequently, an unfavorable relative inclination of the first and second connectors 12, 14 is avoidable during the mutual engagement thereof.

According to the connector system 10 of such a structure, the first guide member 40 and the second guide member 42 operate to prevent the mutual connection between the first and second connectors 12, 14 provided therewith unless a dimension, a shape and an arrangement of the grooves 48 correspond to those of the ribs 52, respectively. Accordingly, it is possible to ensure the reliable connection between electronic an apparatuses while surely avoiding the erroneous connection, if various kinds of connector systems 10 wherein grooves 48 and ribs 52 of various dimensions, shapes and arrangements to be compensatingly engageable with each other are provided in the first connectors 12 and the second connectors 14, respectively, are prepared and attached to various I/O interfaces of electronic apparatuses and I/O cables to be connected thereto.

Figure 5:
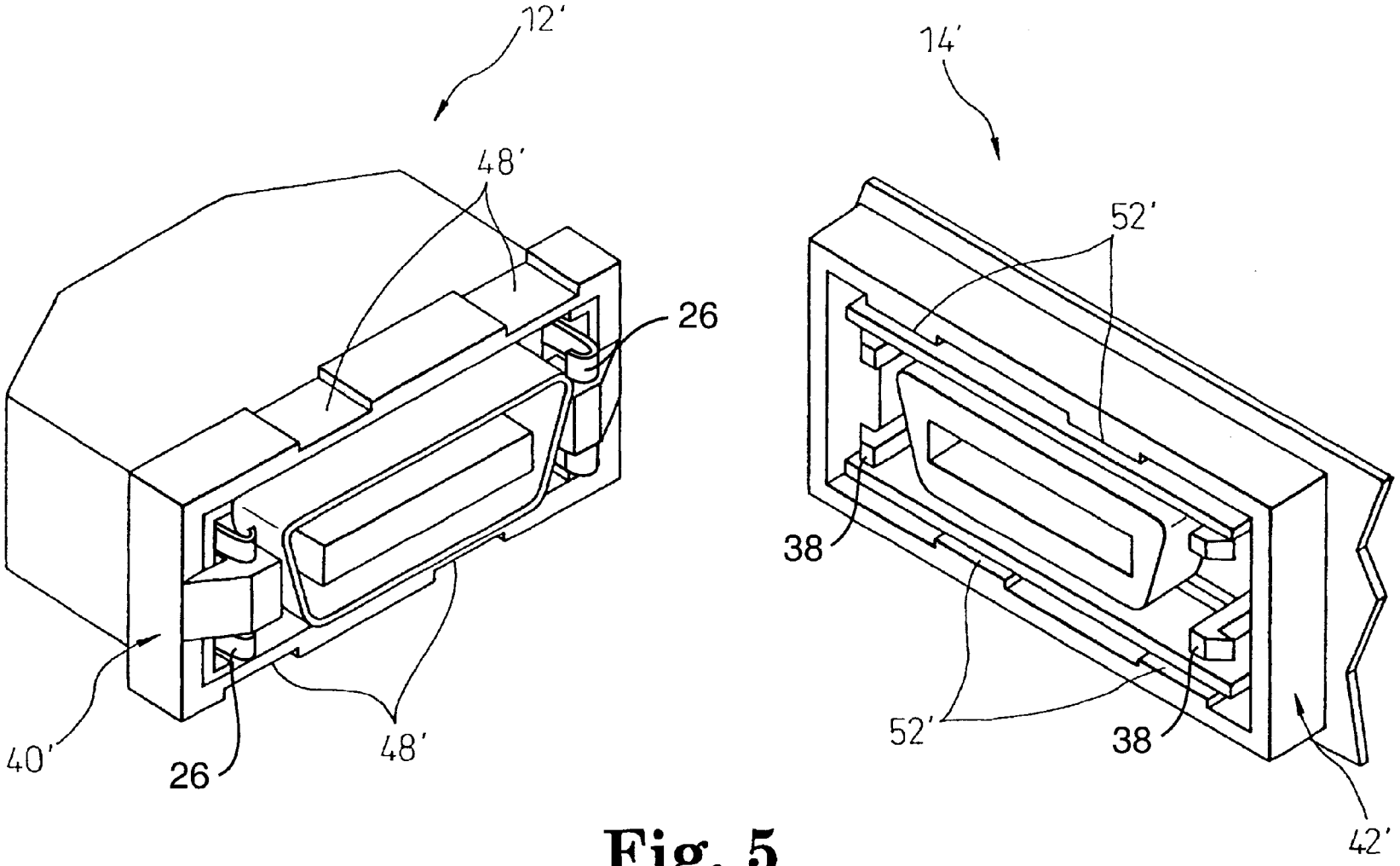
FIG. 5 is a diagrammatic perspective view illustrating a modification of the connector system shown in FIG. 1.

FIG. 5 illustrates a first connector 12' with a first guide member 40' in which a plurality of grooves 48' are arranged at positions different from those of the first guide member 40 shown in FIG. 1, and a second connector 14' with a second guide member 42' in which a plurality of ribs 52' are arranged at positions different from those of the second guide member 42 shown in FIG. 1. The first connector 12' and the second connector 14' are fittable with each other under the compensating engagement between the first guide member 40' and the second guide member 42'. It will be understood that, as described above, since the first guide member 40' cannot be compensatingly engaged with the second guide member 42, the first connector 12' cannot be connected to the second connector 14, and similarly, since the second guide member 42' cannot be compensatingly engaged with the first guide member 40, the second connector 14' cannot be connected to the first connector 12.

In addition, when the first guide member 40 and the second guide member 42 are not compensatingly engaged with each other, since the flat front end surface 44*a* of the first wall 44 of the first guide member 40 abuts to the flat front end faces of the ribs 52 of the second wall 50 of the second guide member 42, the first and second connectors 12, 14 are maintained in a face-to-face arrangement described above. Consequently, a risk of unintentional contact between some of the contacts 18, 30 of the first and second connectors 12, 14 is avoidable.

To ensure the face-to-face arrangement and the parallel translation of the first and second connectors 12, 14 when the both are compensatingly engaged, the grooves 48 of the first guide member 40 are preferably distributed in upper and lower parts of the fitting portion 22 of the first connector 12 divided by a horizontal center plane P1 and left and right parts of the fitting portion 22 divided by a vertical center plane P2 (see FIG. 3). Similarly, the ribs 52 of the second guide member 42 are preferably distributed in upper and lower parts of the fitting portion 32 of the second connector 14 divided by a horizontal center plane R1 and left and right parts of the fitting portion 32 divided by a vertical center plane R2 (see FIG. 4). Such an arrangement of the grooves 48 and the ribs 52 also has an advantage in that the maintenance of the above-mentioned face-to-face arrangement between the first and second connectors 12, 14 is facilitated when the first guide member 40 is not compensatingly engaged with the second guide member 42. Note the groove 48 and the rib 52 may be formed in each of the longitudinal side of the first and second guide members, respectively, while crossing the vertical center plane P2 or R2.

To enable the assembly of the first and second guide members 40, 42 to the first and second connectors 12, 14 having the fitting portions 22, 32 with a polarity, without taking the directionality of the first and second guide members 40, 42 into account, the grooves 48 of the first guide member 40 are preferably arranged at positions symmetric with respect to a center point O of the fitting portion 22 of the first connector 12 (see FIG. 3). Similarly, the ribs 52 of the second guide member 42 are arranged at positions symmetric with a center point Q of the fitting portion 32 of the second connector 14 (see FIG. 4). Thereby, The operability of the assembly of the first and second guide members 40, 42 is improved.

According to the connector system 10, since no opening is provided in the panel 34 for attaching the second connector 14 thereto, except for the opening 34*a* for inserting the fitting portion 32 therethrough, the electromagnetic shielding function is not deteriorated in the I/O interface particularly due to the panel 34. If the first guide member 40 and the second guide member 42 are made of metallic material, the electromagnetic shielding function in the I/O interface is further enhanced since an electromagnetic shielding function due to the first guide member 40 and the second guide member 42 is added to that initially provided in the insulation bodies 16, 28. In this case, a sufficient effect is obtainable even if the second guide member 42 arranged relatively outside is solely made of metallic material. Also, even if either the first guide member 40 or the second guide member 42 is made of metal, there is no projection in either of the first guide member 40 and the second guide member 42, having a length sufficient for easily insertable into the counterpart connector 12, 14, whereby a short circuit between the contacts 18 and 30 caused by a careless mistake is surely avoidable.

The polarizing key mechanism of the connector system 10 is further provided with a pair of abutting sections 54 formed integral with the first wall 44 of the first guide member 40 and extending inward and forward in a cantilever manner from a pair of lateral portions opposed to each other. The first abutting sections 54 are arranged so that they substantially abut to the front surface 16*a* of the body 16 at a front ends and are located adjacent to the fitting portion 22 when the first guide member 40 is attached to the shell 20 of the first connector 12. The respective first abutting section 54 inhibits the mutual connection of the first connector 12 with another connector incapable of compensatingly engaging with the first guide member 40, i.e., a general-purpose female connector described later having no second guide member 42, by the abutment to a predetermined portion of the latter.

On the other hand, the second guide member 42 attached to the panel 34 defines a gap between a pair of lateral portions of the second wall 50 and the fitting portion 32 of the second connector 14, for accommodating the pair of first abutting sections 54 of the first guide member 40, not to interfere with the connection between the first and second connectors 12, 14 having the first and second guide members 40, 42, respectively, compensatingly engageable with each other. The pair of fixed hooks 38 provided in the second connector 14 are of a bifurcate shape (see FIG. 4). Similarly, the pair of pivoted hooks 26 of the first connector 12 is of a bifurcate shape, not to interfere with the first abutting sections 54.

The polarizing key mechanism of the connector system 10 is provided with a pair of second abutting sections 56 extending substantially parallel to a pair of opposite longitudinal portions of the second wall 50 formed integrally with the second guide member 42. The second abutting sections 56 are disposed in the vicinity of the fitting portion 32 of the second connector 14 when the second guide member 42 is attached to the panel 34. The respective second abutting section 56 inhibits the mutual connection of the second connector 14 with another connector incapable of compensatingly engaging with the second guide member 42; i.e., a general-purpose male connector described later having no first guide member 40, by the abutment to a predetermined portion of the latter.

On the other hand, the second guide member 42 attached to the panel 34 defines a gap between a pair of longitudinal portions of the second wall 50 and the fitting portion 32 of the second connector 14, for accommodating a pair of longitudinal portions of the first wall 44 of the first guide member 40, not to interfere with the connection between the first and second connectors 12, 14 having the first and second guide members 40, 42, respectively, compensatingly engageable with each other. Each of a pair of longitudinal edges of the front end 20*a* of the shell 20 of the first connector 12 has a rectangular cut-off area (see FIG. 3).

Figure 8:
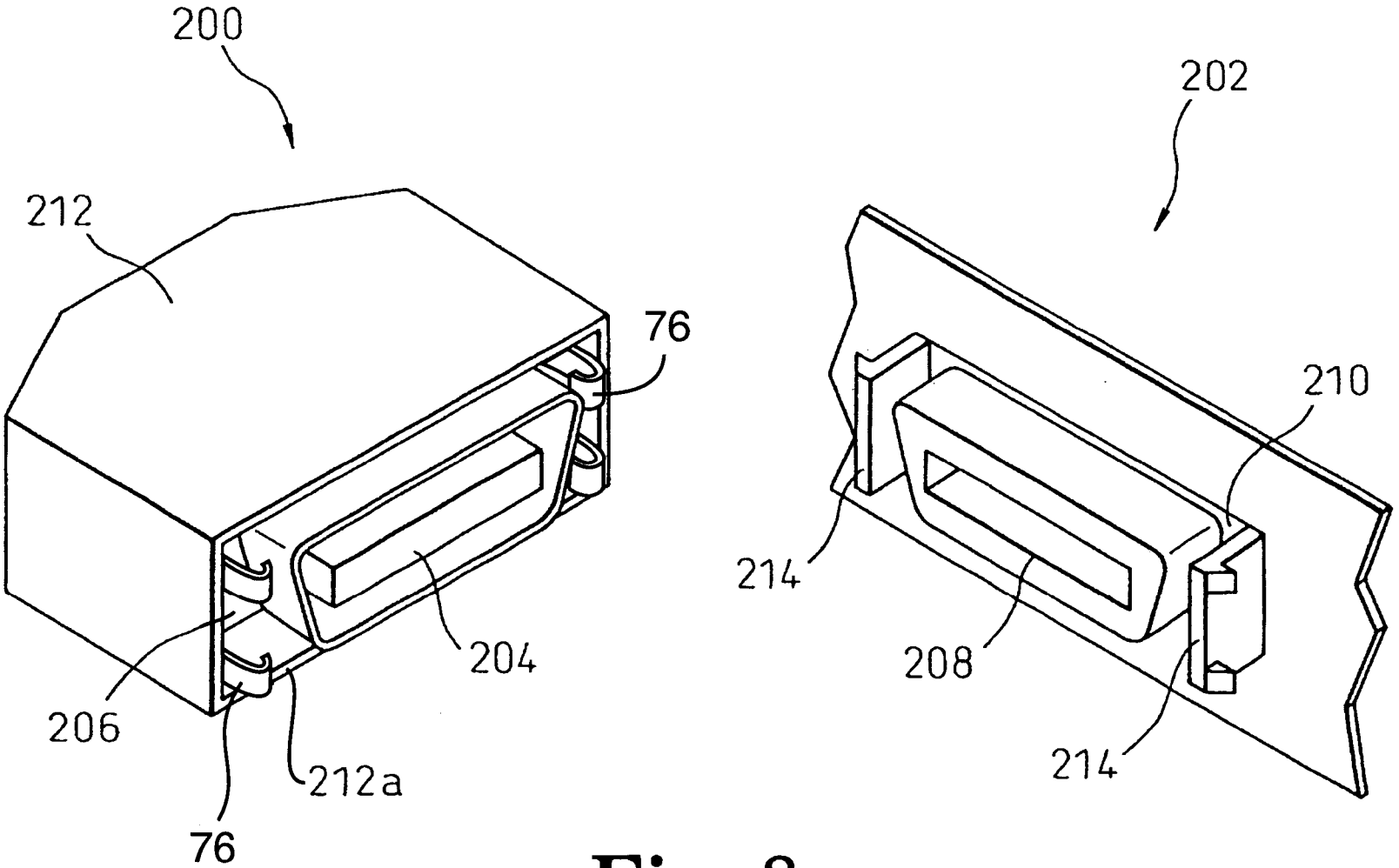
FIG. 8 is a diagrammatic perspective view of a general-purpose connector system having substantially the same connector structure as those of the connector systems shown in FIGS. 1 and 6.

The general-purpose connector which is prevented from being connected with the first and second connectors 12, 14 by means of the first and second abutting sections 54, 56 of the first and second guide members 40, 42 is a male connector 200 and a female connector 202 of substantially the same structure as that of the first and second connectors 12, 14 except that there are no first and second guide members 40, 42 therein, as shown in FIG. 8. That is, a dimension, an arrangement and the number of contact (not shown) of the male connector 200, and a dimension and a shape of a body 206 including a D-shaped fitting portion 204 are the same as those of the first connector 12. While, a dimension, an arrangement and the number of contact (not shown) of the female connector 202, and a dimension and a shape of a body 208 including a D-shaped fitting portion 208 are the same as those of the second connector 14. The male connector 200 and the female connector 202 constitute a general-purpose connector system fitted to each other in a mutually inserting manner.

A shell 212 of the male connector 200 is of substantially the same structure as the shell 20 of the first connector 12, except that the rectangular cut-off area is not provided along each of the pair of longitudinal edges of its front end 212*a* for the purpose of avoiding the abutment to the second abutting section 56 of the second guide member 42. Accordingly, the male connector 200 is fittable to the second connector 14 with no second guide member 42 in an inserting manner, whereby the electric connection is established between both the connectors 14 and 200. As described above, however, to the second connector 14 provided with the second guide member 42, the shell 212 of the male connector 200 abuts by a pair of longitudinal edges of the front end 212*a* to the pair of second abutting sections 56 of the second guide member 42, whereby the mutual connection between the male connector 200 and the second connector 14 is inhibited.

In this regard, it is necessary that the pair of second abutting sections 56 of the second guide member 42 have dimensions large enough for surely avoiding even a slight contact between the contacts of the male connector 200 with the contacts 30 of the second connector 14. Also, to prevent the male connector 200 from tilting relative to the second connector 14 when the front end 212*a* of the shell 212 abuts to the pair of second abutting sections 56 of the second guide member 42, the second abutting sections 56 of the same dimensions are preferably arranged on upper and lower sides of the fitting portion 32 in a symmetric manner.

On the other hand, a pair of stationary hooks 214 of the female connector 202 is of substantially the same structure as the pair of fixed hooks 38 of the second connector 14, except that the former has no bifurcate shape necessary for avoiding the abutment with the first abutting section 54 of the first guide member 40. Accordingly, the female connector 202 can be fitted in an inserting manner to the first connector 12 having no first guide member 40 to establish the electric connection between both the connectors 12, 202. As described above, however, to the first connector 12 provided with the first guide member 40, the pair of stationary hooks 214 of the female connector 202 abuts by a front ends thereof to the pair of first abutting sections 54 of the first guide member 40, whereby the mutual connection between the female connector 202 and the first connector 12 is inhibited.

In this regard, it is necessary that the pair of first abutting sections 54 of the first guide member 40 have dimensions large enough for surely avoiding even a slight contact between the contacts of the female connector 202 and the contacts 18 of the first connector 12. Also, to prevent the first connector 12 from tilting relative to the female connector 202 when the front ends of the pair of stationary hooks 214 abuts to the pair of first abutting sections 54 of the first guide member 40, the first abutting sections 54 of the same dimensions are preferably arranged on left and right sides of the fitting portion 22 in a symmetric manner. In this case, a pressure applied to the first abutting sections 54 is received by the front surface 16*a* of the connector body 16.

When various kinds of I/O cables in which various first connectors 12 and male connectors 200 are mixedly used are connected to various kinds of electronic apparatuses in which various second connectors 14 and the female connectors 202 are mixedly used, a specific combination of the apparatuses is solely allowed to be connected but other combination than the above is surely inhibited from being connected as described above. During the connecting operation, since the inclination of the first connector 12 relative to the female connector 202 and that of the male connector 200 relative to the second connector 14 are effectively inhibited by the above-mentioned symmetric arrangement of the first abutting sections 54 and the second abutting sections 56, there is no risk in that some of contacts of the connectors 12, 14, 200, 202 are partially in contact with each other to cause the erroneous connection.

When at least one of the first guide member 40 and the second guide member 42 is made of metal, the first abutting section 54 and the second abutting section 56 preferably have a dimension incapable of being easily inserted into the fitting portions of the counterpart connectors 12, 14. Thereby, it is possible to surely prevent the contacts 18, 30 from being in contact with each other by a careless connecting operation.

The connector system 10 of such an arrangement may be particularly suitably employed in a case wherein conventional connectors are mixedly used together with connectors for an interface of the above-mentioned new standard type. In other words, when the above-mentioned male connector 200 is a conventional connector, the first connector 12 having the same main body 206 and contacts as those of the conventional connector can be converted to a connector for the new standard type interface capable of surely preventing the erroneous insertion into the male connector 200, by somewhat modifying the shell 212 of the conventional male connector 200 as well as adding the first guide member 40. Similarly, when the above-mentioned male connector 202 is a conventional connector, the second connector 14 having the same main body 210 and contacts as those of the conventional connector can be converted to a connector for the new standard type interface capable of surely preventing the erroneous insertion into the male connector 200, by somewhat modifying the pair of stationary hooks 214 of the conventional female connector 202 as well as adding the second guide member 42.

Figure 6:
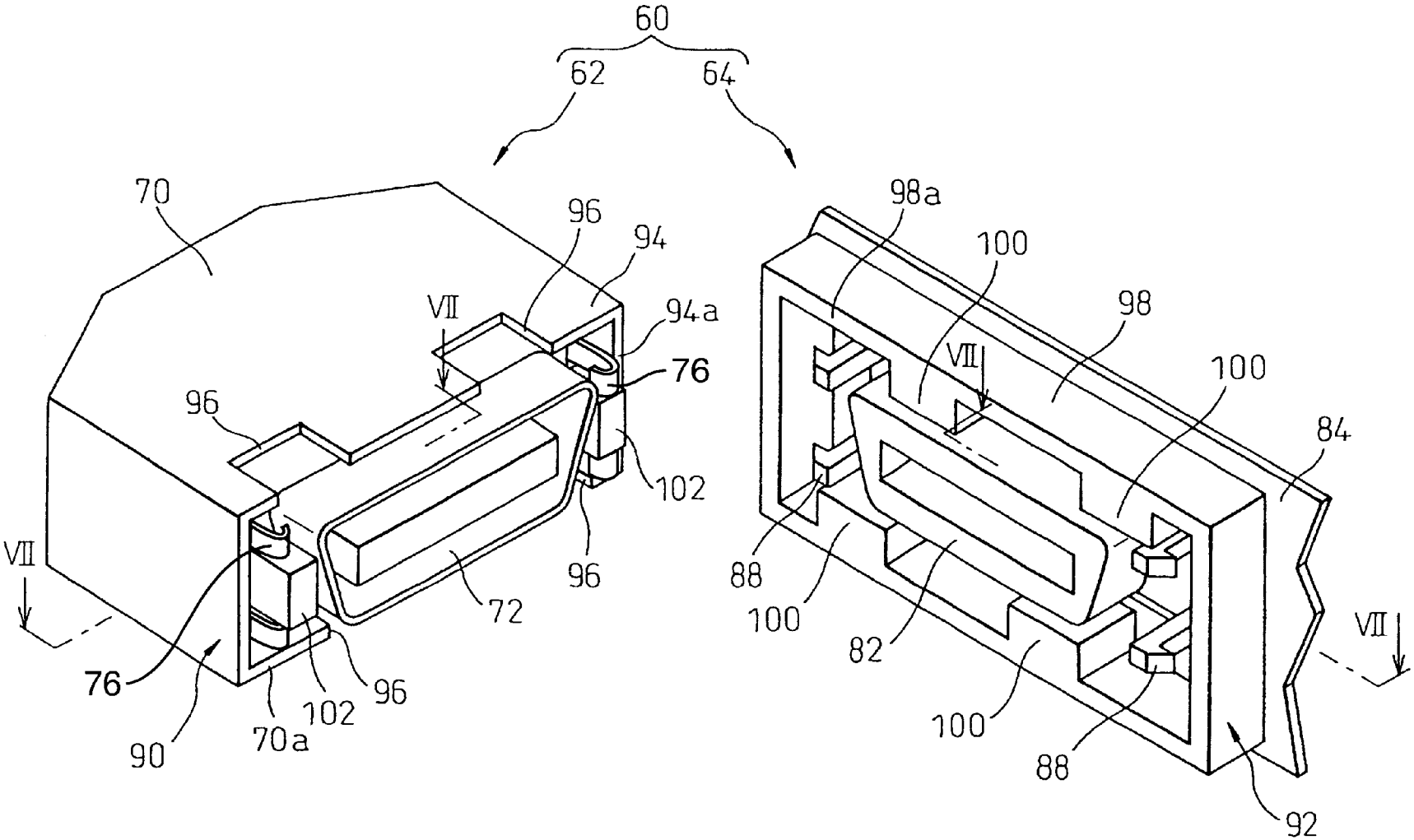
FIG. 6 is a diagrammatic perspective view illustrating another embodiment of the connector system according to the present invention.
Figure 7:
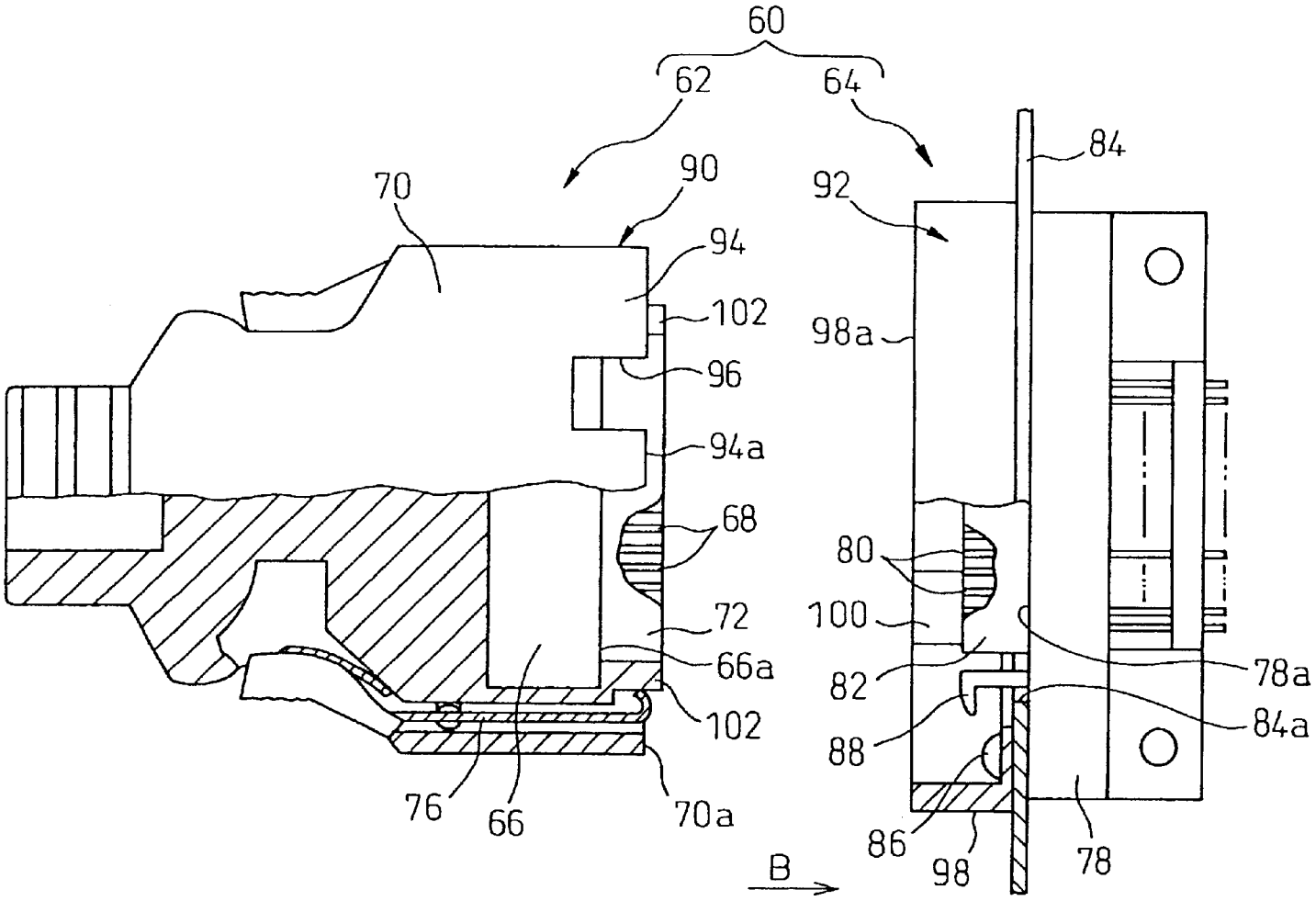
FIG. 7 is a partially sectional plan view, taken long line VII—VII, of the connector system shown in FIG. 6.

FIGS. 6 and 7 are a diagrammatic perspective view and a partially sectional plan view, respectively, of a connector system 60 according to a second aspect of the present invention. The connector system 60 has a pair of first and second connectors 62, 64, each having a fitting portion to be fitted to a counterpart fitting portion in a mutually inserting manner to establish an electrical connection between the both and a polarizing key mechanism permitting only a specific combination of the first and second connectors to be connected to each other. Accordingly, the connector system 60 is suitably used for an I/O interface of an electronic apparatus.

The first connector 62 includes a main body 66 and contacts 68 which are of the same structure as the main body 16 and the contacts 18 of the first connector 12 shown in FIG. 1, and is used as a male connector to be provided on an I/O interface side. A shell 70 for covering the main body 66 is molded, for example, of a resinous material in integral with the main body 66.

In this case, the shell 70 is formed by an injection molding of the resinous material carried out while placing the main body 66 within a predetermined mold with the contacts 68 being connected to cables. The shell 70 is open at a front end 70*a* to expose a male type fitting portion 72 of the main body 66 therefrom.

The shell 70 is further provided with a pair of pivoted hooks 76 having substantially the same structure as that of the pair of pivoted hooks 26 of the first connector 12.

The second connector 64 includes a main body 78 and contacts 80 which are of the same structure as the main body 28 and the contacts 30 of the second connector 14 shown in FIG. 1, and is used as a female connector to be provided on a circuit board side of an electronic apparatus. Similar to the second connector 14, the second connector 64 is fixed to a metallic panel 84 by bolts 86 while exposing a female type fitting portion 82 of the main body 78 outside from an opening 84*a* of the panel 84 in a housing of the apparatus. On a front surface 78*a* of the main body 78, there are a pair of fixed hooks 88 having substantially the same structure as that of the pair of fixed hooks 38 of the second connector 14.

The polarizing key mechanism for the connector system 60 includes a first frame-shaped guide section 90 disposed around the fitting portion 72 of the first connector 62 and a second frame-shaped guide member 92 disposed around the fitting portion 82 of the second connector 64. As shown in FIGS. 6 and 7, the first guide section 90 is constituted by a generally rectangular frame-shaped first wall portion 94 located adjacent to the front end 70*a* of the shell 70 and surrounding the fitting portion 72 of the first connector 62 via a gap. Two cutout grooves 96 are spaced from each other in the first wall portion 94 of the first guide section 90 along a pair of opposed longitudinal edges thereof, respectively. The respective cutout groove 96 extends linearly in the direction vertical to a generally flat front end surface 94*a* of the first wall portion 94, as well as in parallel to the inserting direction (the arrowed direction B in FIG. 7) of the first connector 66 into the second connector 64.

As shown in FIGS. 6 and 7, the second guide member 92 has a generally rectangular frame-shaped second wall 98 surrounding the fitting portion 82 via a gap, and secured to a front surface of the panel 84, for example, by bolts 86 for fixing the second connector 64 to the panel 84. The second wall 98 of the second guide member 92 has a dimension and a shape capable of receiving the first wall portion 94 with the inner surface of the second wall 98 being in contact as a whole with the outer surface of the first wall portion 94 of the first guide section 90. Two ribs 100 are formed on each of inner surfaces of a pair of opposite longitudinal sides of the second wall 98 of the second guide member 92. The respective rib 100 has a dimension, a shape and an arrangement compensatingly engageable with each of the cutout grooves 96 of the first guide section 90, and linearly extends in the vertical direction to a generally flat front end surface 98*a*. When the second guide member 92 is mounted to a predetermined position on the panel 84, the respective rib 100 extends in parallel to the connector-inserting direction B described above. A front end surface of the respective rib 100 is located on the extension of the generally flat front end surface 98*a* of the second wall 98.

The first guide section 90 and the second guide member 92 permit the mutual connection of the first connector 62 with the second connector 64 when the cutout grooves 96 and the ribs 100 thereof are compensatingly engageable. That is, the first guide section 90 can be received solely in a specific second guide member 92 having the ribs 100 located at positions corresponding to those of the cutout grooves 96 under the compensating engagement of the respective cutout grooves 96 with the corresponding ribs 100, and thereby, the specific combination of the first and second connectors 62 and 64 having the first guide section 90 and the second guide member 92 is allowed to be engaged with each other.

The first guide section 90 is smoothly accommodated in the second guide member 92 when the compensating engagement is substantially simultaneously started between the cutout grooves 96 and the ribs 100 by opposing the front end surface 94*a* of the first wall portion 94 of the first guide section 90 substantially parallel to the front end surface 98*a* of the second wall 98 of the second guide member 92. At this time, the first and second connectors 62, 64 are relatively positioned so that the fitting portions 72, 82 thereof are in a face-to-face arrangement, and the mutual engagement is carried out in this condition. Further, under the compensating engagement of the cutout grooves 96 and the ribs 100, the first and second connectors 62, 64 are guided so that the fitting portions 72, 82 are subjected to a parallel translation while maintaining a face-to-face arrangement.

Consequently, an unfavorable relative inclination of the first and second connectors 62, 64 is avoidable during the mutual engagement thereof.

According to the connector system 60 of such a structure, the first guide section 90 and the second guide member 92 operate to prevent the mutual engagement between the first and second connectors 62, 64 provided therewith unless a dimension, a shape and an arrangement of the cutout grooves 96 correspond to those of the ribs 100, respectively. Accordingly, it is possible to establish the reliable connection between electronic apparatuses while surely avoiding the erroneous connection, if various kinds of connector systems 60 wherein cutout grooves 96 and ribs 100 of various dimensions, shapes and arrangements to be compensatingly engageable with each other are provided in the first connectors 62 and the second connectors 64, respectively, are prepared and attached to various I/O interfaces of electronic apparatuses and I/O cables to be connected thereto.

In addition, when the first guide section 90 and the second guide member 92 are not compensatingly engaged with each other, since the flat front end surface 94*a* of the first wall portion 94 of the first guide section 90 abuts to the flat front end of the ribs 100 of the second wall 98 of the second guide member 92, the first and second connectors 62, 64 are maintained in a face-to-face arrangement described above. Consequently, a risk of unintentional contact between some of the contacts 18, 30 of the first and second connectors 62, 64 is avoidable.

To ensure the face-to-face arrangement and the parallel translation of the first and second connectors 62, 64 when the both are mutually engaged, the cutout grooves 96 of the first guide section 90 are preferably distributed in upper and lower parts of the fitting portion 72 of the first connector 62 divided by a horizontal center plane and left and right parts of the fitting portion 72 divided by a vertical center plane similar to the above-mentioned plurality of grooves 48 of the first guide member 40. Also, similar to the ribs 52 of the second guide member 42 as described before, the ribs 100 of the second guide member 92 are preferably distributed in upper and lower parts of the fitting portion 82 of the second connector 64 divided by a horizontal center plane and left and right parts of the fitting portion 82 divided by a vertical center plane. Such an arrangement of the cutout grooves 96 and the ribs 100 also has an advantage in that the maintenance of the abovementioned face-to-face arrangement between the first and second connectors 62, 64 is facilitated when the first guide section 90 is not compensatingly engaged with the second guide member 92. Note the cutout groove 96 and the rib 100 may be formed in each of the longitudinal side of the first and second guide members, respectively, while crossing the vertical center plane.

To enable the assembly of the first guide section 90 and the second guide member 92 to the first and second connectors 62, 64 having the fitting portions 72, 82 with a polarity, without taking the directionality of the first guide section 90 and the second guide members 92 into account, the cutout grooves 96 of the first guide section 90 are preferably arranged at positions symmetric with respect to a center point of the fitting portion 72 of the first connector 62. Similarly, the ribs 100 of the second guide member 92 are arranged at positions symmetric with a center point of the fitting portion 82 of the second connector 64. Thereby, the workability in the molding process of the first guide section 90, i.e., the shell 70, and that in the assembly of the second guide member 92 are improved.

According to the connector system 60, the electromagnetic shielding function is not deteriorated in the I/O interface particularly due to the panel 34.

If the second guide member 92 is made of metallic material, the electromagnetic shielding function in the I/O interface is further enhanced since an electromagnetic shielding function due to the second guide member 92 is added to that initially provided in the main bodies 66, 78. Since there is no projection in the second guide member 92 having such a dimension as to facilitate the insertion thereof into the counterpart fitting portion 72 of the first connector 62, the short circuit of the contacts 68 due to the careless mistake is avoidable even if the second guide member 92 is made of metal.

The polarizing key mechanism of the connector system 60 is further provided with a pair of first abutting sections 102 formed integral with the shell 70 and the first guide section 90 of the first connector 62 and extending forward generally in parallel to a pair of opposite lateral portions of the first wall portion 94. The first abutting sections 102 are arranged adjacent to the fitting portion 72 of the main body 66 of the first connector 62. The respective first abutting section 102 operates to abut to a predetermined position of another connector which is not compensatingly engageable with the first guide section 90; i.e., a general-purpose female connector (such as a female connector 202) having no second guide member 92, to inhibit the mutual connection of the first connector 62 with the general-purpose female connector.

On the other hand, the second guide member 92 attached to the panel 84 defines a gap between a pair of lateral portions of the second wall 98 and the fitting portion 82 of the second connector 64, for accommodating the pair of first abutting portions 102 of the first guide section 90, not to interfere with the connection between the first and second connectors 62, 64 having the first guide section 90 and the second guide member 92, respectively, compensatingly engageable with each other. Each of the pair of fixed hooks 88 provided in the second connector 64 is of a bifurcate shape not to be in contact with the first abutting section 102.

Similarly, each of the pair of pivoted hooks 76 is of a bifurcate shape not to interfere with the first abutting section 102.

In the polarizing key mechanism for the connector system 60, the ribs 100 formed in the second guide member 92 extend close to the fitting portion 82 of the second connector 64 to operate as second abetting sections. The rib 100 used as the second abetting section abuts to a predetermined position of another connector such as a general-purpose male connector (male connector 200) having no first guide section 90, which is not compensatingly engageable with the second guide member 92, to inhibit the mutual connection of the second connector 64 with the general-purpose male connector. Contrarily, since the first guide section 90 is receivable in the second guide member 92 by the compensating engagement of the cutout grooves 96 with the ribs 100, the connection is permissible between the first and second connectors 62, 64 having the first guide section 90 and the second guide member 92 compensatingly engageable with each other.

Similar to the connector system 10, in the connector system 60 of such a structure, a shell 212 of the above-mentioned female connector 200 abuts by a pair of longitudinal edges of a front end 212*a* thereof to the ribs 100 constituting the second abutting section of the second guide member 92 to inhibit the mutual connection between the male connector 200 and the second connector 64. Also, the above-mentioned pair of stationary hooks 214 of the female connector 202 abut by front ends thereof to the pair of first abutting sections 102 to inhibit the mutual connection between the female connector 202 and the first connector 62.

Thus, similar to the connector system 10, it will be understood that the connector system 60 is effectively used when the conventional connector is used in the interface of the above-mentioned new standard type. In this case, the first connector 62 can be manufactured as the connector for the new standard type interface capable of reliably preventing the erroneous insertion thereof into the male connector 200 solely by forming the shell 70 of a predetermined shape by an injection molding process in place of the shell 212 of the conventional male connector 200, whereby man-hours necessary for the production of the connector can be reduced.

While the present invention has been described above with reference to the preferred embodiments thereof, the present invention should not be limited thereto but includes various changes and modifications. For example, the first guide member 40 and the second guide member 42, 92 are not restricted to a correct rectangular frame shape as illustrated but may be of a rectangular frame shape divided into upper and lower portions or right and left portions. Also, contrary to the preceding embodiments, the first guide section may have ribs and the second guide section may have grooves to be compensatingly engageable with the former. Further, the second guide section may be formed as a frame portion molded in integral with the panel fixed to the insulation body of the second connector. This frame portion may have the same structure as that of the above-mentioned second guide member 42, 92.

EFFECT OF THE INVENTION

As apparent from the foregoing description, according to the present invention, a connector system with a polarizing key function permitting only a specific combination of connectors is provided, wherein a first guide member of a first connector and a second guide member of a second connector allow the mutual connection between the first and second connectors when a plurality of engaging sections thereof members are compensatingly engageable with each other, and the fitting portions of the first and second connectors are guided to cause a parallel translation while maintaining a face-to-face arrangement. Thereby, it is possible to prevent the connectors from being erroneously inserted to each other while surely avoiding a partial contact of contacts and a short circuit, which significantly enhances the safety of high-performance electronic apparatuses when the same are connected to each other.

When the first and second abutting sections are provided in the first and second connectors, respectively, it is possible to surely inhibit the erroneous insertion not only of connectors having the polarizing key mechanism according to the present invention but also of those having no such a mechanism. If at least one of the first and second guide members is made of metal, an electromagnetic shielding function is further facilitated in an I/O interface. If a plurality of engaging sections in the first and second guide members are symmetrically arranged in relation to a center point of the respective engaging section, it is possible to easily and correctly add a polarizing key function to a connector having a polarity in the fitting portion thereof.

DESCRIPTION OF REFERENCE NUMERALS

12, 62 . . . first connector
14, 64 . . . second connector
20, 70 . . . shell
22, 32, 72, 82 . . . fitting portion
34, 84 . . . panel
40 . . . first guide member
42, 92 . . . second guide member
44 . . . first wall
48 . . . groove
50, 98 . . . second wall
52, 100 . . . rib
54, 102 . . . first abutting section
56 . . . second abutting section
90 . . . first guide section
94 . . . first wall portion
96 . . . cutout groove

What is claimed is:

1. A connector system comprising a pair of first and second connectors, each of which includes a fitting portion to be fitted with a counterpart fitting portion in a mutually inserting manner to establish an electrical connection between the first and second connectors, and a polarizing key mechanism permitting only a specific combination of the first and second connectors to be connected with each other, characterized in that said polarizing key mechanism comprises:

a first guide member provided around said fitting portion of said first connector, said first guide member including a plurality of engaging sections; and a second guide member provided around said fitting portion of said second connector, said second guide member including a plurality of engaging sections which can be compensatingly engaged with said plurality of engaging sections of said first guide member;

wherein said first and second guide members permit said first and second connectors to be connected with each other only when said engaging sections of said first guide member are compensatingly engaged with said engaging sections of said second guide member, and guide said first and second connectors under a compensating engagement between said engaging sections in such a direction as to cause a parallel translation of said fitting portions of said first and second connectors while maintaining a face-to-face arrangement of said fitting portions; and wherein said fitting portion of each of said first and second connectors has a polarity, and wherein said engaging sections of each of said first and second guide members are located at positions symmetric with respect to a center point of said fitting portion of each of said first and second connectors.

2. A connector system as set forth in claim 1, wherein said engaging sections of each of said first and second guide members are located at both sides of a horizontal sectional center plane dividing said fitting portion of each of said first and second connectors into upper and lower parts and at both sides of a vertical sectional center plane dividing said fitting portion into right and left parts.

3. A connector system as set forth in claim 1, wherein said polarizing key mechanism further comprises a first abutting section provided in said first connector in association with said first guide member for abutment with another connector which cannot be compensatingly engaged with said first guide member to prevent said first connector from being connected with the other connector, and a second abutting section provided in said second connector in association with said second guide member for abutment with further connector which cannot be compensatingly engaged with said second guide member to prevent said second connector from being connected with the further connector.

4. A connector system as set forth in claim 1, wherein said first guide member includes a first wall substantially surrounding said fitting portion of said first connector, said engaging sections of said first guide member being grooves formed on said first wall and extending along a direction of insertion of said first connector to said second connector, and wherein said second guide member includes a second wall substantially surrounding said fitting portion of said second connector to define a gap for receiving said first wall between said second wall and said fitting portion, said engaging sections of said second guide member being ribs formed on said second wall and extending along a direction of insertion of said second connector to said first connector, said ribs being adapted to be compensatingly engaged with said grooves.

5. A connector system as set forth in claim 1, wherein said first connector includes an insulation body provided with said fitting portion and supporting a plurality of contacts, and a shell for covering said insulation body, and wherein said first guide member is structured as a frame member attached to said shell.

6. A connector system as set forth in claim 1, wherein said first connector includes an insulation body provided with said fitting portion and supporting a plurality of contacts, and a shell for covering said insulation body, and wherein said first guide member is structured as a part of said shell located around said fitting portion.

7. A connector system as set forth in claim 1, wherein said second connector includes an insulation body provided with said fitting portion and supporting a plurality of contacts, said insulating body being secured to a panel with an opening into which said fitting portion is inserted, and wherein said second guide member is structured as a frame member attached to said panel.

8. A connector system as set forth in claims 1, wherein said second connector includes an insulation body provided with said fitting portion and supporting a plurality of contacts, said insulating body being secured to a panel with an opening into which said fitting portion is inserted, and wherein said second guide member is structured as a frame part integrally formed with said panel.

* * * * *

UNITED STATES PATENT AND TRADEMARK OFFICE

CERTIFICATE OF CORRECTION

PATENT NO. : 6,302,744 B1
DATED : October 16, 2001
INVENTOR(S) : Nomura, Satoshi It is certified that error appears in the above-identified patent and that said Letters Patent is hereby corrected as shown below:

Column 2,
Line 18, delete “And”.

Column 5,
Line 32, delete “35”.

Column 6,
Line 57, delete “an”.

Signed and Sealed this

Tenth Day of September, 2002

*Attest:*

*Attesting Officer*

JAMES E. ROGAN
*Director of the United States Patent and Trademark Office*